US008305336B2

(12) United States Patent
Park et al.

(10) Patent No.: US 8,305,336 B2
(45) Date of Patent: Nov. 6, 2012

(54) METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

(75) Inventors: Woo-Il Park, Yongin-si (KR); Seung-Je Lee, Seongnam-si (KR); Sung-Jin Jang, Daejeon (KR); Sang-Heon Park, Asan-si (KR); Sang-Jun Lee, Jeollanam-do (KR); Sang-Moon Moh, Hwaseong-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 625 days.

(21) Appl. No.: 12/470,214

(22) Filed: May 21, 2009

(65) Prior Publication Data

US 2010/0156302 A1 Jun. 24, 2010

(51) Int. Cl.
*G09G 3/36* (2006.01)

(52) U.S. Cl. ..... 345/102; 345/207

(58) Field of Classification Search ..... 345/102, 345/207

See application file for complete search history.

(56) References Cited

U.S. PATENT DOCUMENTS

| | | | | |
|---|---|---|---|---|
| 6,172,759 | B1 | 1/2001 | Goldstein | |
| 7,772,788 | B2 * | 8/2010 | Park et al. | 315/291 |
| 7,893,916 | B2 * | 2/2011 | Wei | 345/102 |
| 7,995,027 | B2 * | 8/2011 | Hong | 345/102 |
| 2005/0140612 | A1 * | 6/2005 | Baek | 345/83 |
| 2006/0274027 | A1 * | 12/2006 | Yamaguchi | 345/102 |
| 2009/0140973 | A1 * | 6/2009 | Kim et al. | 345/102 |

FOREIGN PATENT DOCUMENTS

| | | |
|---|---|---|
| JP | 2000-075562 | 3/2000 |
| JP | 2006-276725 | 10/2006 |
| JP | 2008-186627 | 8/2008 |

OTHER PUBLICATIONS

English Abstract for Publication No. 2000-075562.
English Abstract for Publication No. 2006-276725.
English Abstract for Publication No. 2008-186627.

* cited by examiner

*Primary Examiner* — Chanh Nguyen
*Assistant Examiner* — Kwang-Su Yang
(74) *Attorney, Agent, or Firm* — F. Chau & Associates, LLC

(57) ABSTRACT

A light source apparatus includes a light source module, a light sensor, a data converter, a light source controller and a light source driver. The light source module includes a light source. The light sensor generates sensing data by sensing the amount of light generated from the light source. The data converter converts the sensing data which exceeds a maximum value of reference data of a control range into converted sensing data within the control range. The light source controller generates a control signal for controlling the amount of light from the light source based upon the sensing data corresponding to no more than the maximum value or based upon the converted sensing data. The light source driver drives the light source by providing the light source with a driving signal based upon the control signal.

14 Claims, 4 Drawing Sheets

METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

CROSS-REFERENCE TO RELATED APPLICATION

This application claims priority to and the benefit of Korean Patent Application No. 2008-130860, filed on Dec. 22, 2008 in the Korean Intellectual Property Office (KIPO), the entire content of which is incorporated by reference herein.

BACKGROUND OF THE INVENTION

1. Field of the Invention

The present disclosure relates to light sources, and more particularly, to a method of driving a light source used in a liquid crystal display (LCD) apparatus, a light source apparatus for performing the method and a display apparatus having the light source apparatus.

2. Discussion of the Related Art

Generally, LCD devices have thinner thickness, lighter weight, lower driving voltage and lower power consumption as compared to other display devices, such as cathode ray tube (CRT) devices and plasma display panel (PDP) devices. As a result, LCD devices are widely employed for various electronic devices such as monitors, laptop computers, cellular phones, and the like. The LCD device typically includes an LCD panel that displays images using a light-transmitting ratio of liquid crystal molecules and a backlight assembly disposed below the LCD panel to provide the LCD panel with light.

The LCD panel includes an array substrate, an opposite substrate and a liquid crystal layer. The array substrate includes a plurality of signal lines, a plurality of thin-film transistors (TFTs) and a plurality of pixel electrodes. The opposite substrate faces the array substrate and has a common electrode. The liquid crystal layer is interposed between the array substrate and the opposite substrate.

The backlight assembly has employed a plurality of cold cathode fluorescent lamps (CCFLs) as a light source. However, recently, light-emitting diodes (LEDs) have been employed for the backlight assembly for low power consumption and high color reproducibility.

The LCD device further includes a driver and a controller to drive the backlight assembly. The controller controls the driver using high speed pulse width modulation (PWM) to control the amount of light from the LEDs. The PWM control methodology provides a static current to the LEDs through pulse generation, pulse width comparison and modulation.

The LEDs typically include a red (R) LED, a green (G) LED and a blue (B) LED, collectively known as RGB LEDs. Red light, green light and blue light emitted from the RGB LEDs, respectively, is mixed to provide white light. However, the luminance characteristics of the individual LEDs may vary in accordance with usage time and the temperature of the LED surroundings, such that a white balance may not be achieved.

To address the issue of white balance, the backlight assembly detects the amounts of light by using a color sensor having a sensitivity of wavelengths corresponding to each of the RGB LEDs. That is, the backlight assembly detects the amounts of RGB light by using RGB color sensors, and provides the controller with detected amounts of light. The controller compares the detected amounts of light with light information stored in a look up table (LUT), and calculates a compensating value. To control the luminance of the RGB light, the controller would feedback a PWM signal for each of the RGB light to the driver based upon the calculated compensating value.

However, when the LEDs deteriorate, the amount of light generated from the LED exceeds a control range of the controller such that an accurate control is unable to be effectively carried out.

SUMMARY OF THE INVENTION

An exemplary embodiment of the present invention provides a method of driving a light source capable of controlling the amount of light even though sensing data exceeds a control range.

An exemplary embodiment of the present invention also provides a light source apparatus for performing the above-mentioned method.

An exemplary embodiment of the present invention also provides a display apparatus having the above-mentioned light source apparatus.

In accordance with an exemplary embodiment of the present invention, sensing data is generated by sensing an amount of light generated from a light source. The sensing data that exceeds a maximum value of reference data of a control range is converted into converted sensing data within the control range. A control signal is generated that controls the amount of light generated from the light source based upon sensing data corresponding to no more than the maximum value or based upon the converted sensing data. The light source is driven by a driving signal based upon the control signal.

The relationship between the sensing data and a duty cycle of the driving signal may be linear. The relationship between the reference data and the duty cycle of the driving signal may be linear.

When the sensing data is substantially equal to or exceeds the maximum value of the reference data, a duty cycle value of the driving signal corresponding to the sensing data may be obtained. A slope of the sensing data as a function of the duty cycle of the driving signal may be calculated. The sensing data may be converted into converted sensing data within the control range based upon the slope.

GSD=SD*(a/b) may be calculated, where GSD is sensing data that is converted to be within the control range, SD is sensing data exceeding the maximum value of the reference data, a is a slope of reference data as a function of the duty cycle of the driving signal, and 'b' is the slope of sensing data as a function of the duty cycle of the driving signal.

The reference data that determines the slope of the reference data as a function of the duty cycle of the driving signal may be about 80% to about 90% of the maximum value of the reference data at a maximum duty cycle.

The light source may include a plurality of light sources generating colored light.

The amount of light from each of the light sources may be sensed to provide sensed amounts of light. The sensed amounts of light may be amplified to provide amplified sensed amounts of light. Sensing data may be generated by converting the amplified sensed amounts of light into digital values.

The amount of light may be sensed at different wavelength ranges.

A control signal may be generated that controls the amount of light from the light source such that the amount of the light corresponds to a target color coordinate value and a target luminance value.

In accordance with an exemplary embodiment of the present invention, a light source apparatus includes a light source module having a light source. A light sensor generates sensing data by sensing an amount of light generated from the light source. A data converter converts the sensing data which exceeds a maximum value of reference data of a control range into converted sensing data within the control range. A light source controller generates a control signal that controls the amount of light generated from the light source based upon sensing data corresponding to no more than the maximum value or based upon the converted sensing data. A light source driver drives the light source by providing the light source with a driving signal based upon the control signal.

The data converter may convert the sensing data outside the control range based upon a slope of the sensing data as a function of the duty cycle of the driving signal.

The data converter may convert the sensing data by calculating GSD=SD*(a/b), where: GSD is sensing data that is converted to be within the control range, SD is sensing data that exceeds the maximum value of the reference data, a is a slope between the reference data and the duty cycle of the driving signal, and 'b' is a slope between the sensing data and the duty cycle of the driving signal.

The light source may include a red light-emitting diode, a green light-emitting diode and a blue light-emitting diode.

The light sensor may include a red light sensor that senses an amount of red light emitted from the red light-emitting diode to provide sensed red light data; a green light sensor that senses an amount of green light emitted from the green light-emitting diode to provide sensed green light data; a blue light sensor the senses an amount of blue light that is emitted from the blue light-emitting diode to provide sensed blue light data; a red light amplifier that amplifies the sensed red light data to provide amplified sensed red light data; a green light amplifier that amplifies the sensed green light data to provide amplified sensed green light data; a blue light amplifier that amplifies the sensed blue light data to provide amplified sensed blue light data; and an analog-digital converter that converts the amplified sensed red light data into digital red light sensing data, that converts the amplified sensed green light data into digital green light sensing data, and that converts the amplified sensed blue light data into digital blue light sensing data.

Each of the red light sensor, the green light sensor and the blue light sensor may include a plurality of sensors respectively sensing the amount of red light, green light and blue light at different wavelength ranges.

The control signal may control the amount of light generated from the light source such that the amount of light corresponds to a target color coordinate value and a target luminance value.

The control signal may control the amount of light generated from the light source by a pulse width modulation of the driving signal.

In accordance with an exemplary embodiment of the present invention a display apparatus includes a display panel that displays an image. A light source module includes a light source, the light source module providing the display panel with light. A light sensor generates sensing data by sensing the amount of light generated from the light source. A data converter converts the sensing data which exceeds a maximum value of reference data of a control range into converted sensing data within the control range. A light source controller generates a control signal for controlling the amount of light generated from the light source based upon sensing data corresponding to no more than the maximum value or based upon the converted sensing data. A light source driver drives the light source by providing the light source with a driving signal based upon the control signal.

DETAILED DESCRIPTION OF EXEMPLARY EMBODIMENTS

Figure 1:
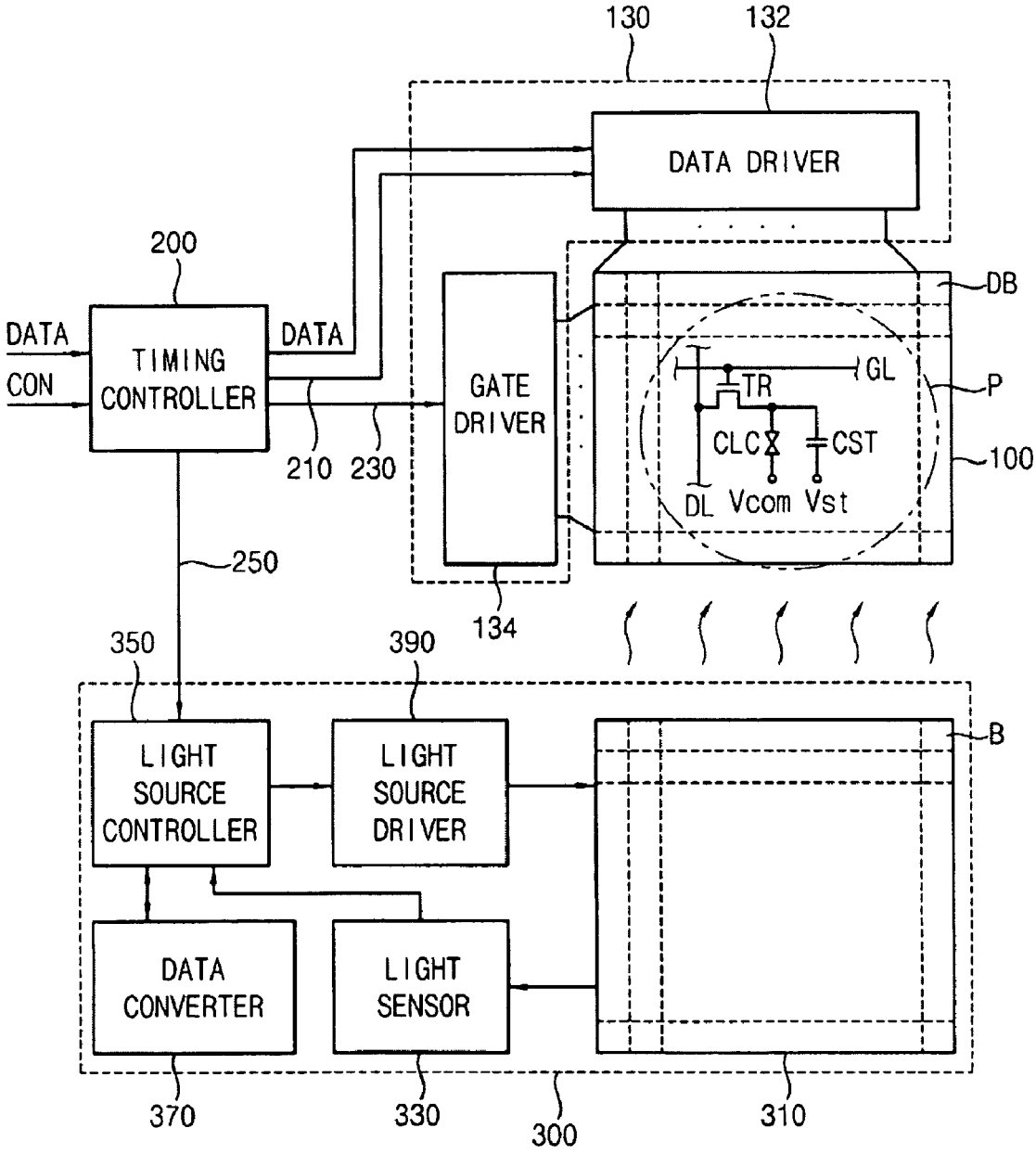
FIG. 1 is a block diagram illustrating a display apparatus according to an exemplary embodiment of the present invention.

The present invention is described more fully hereinafter with reference to the accompanying drawings, in which example embodiments of the present invention are shown. The present invention may, however, be embodied in many different forms and should not be construed as limited to the example embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present.

Referring now to FIG. 1, a display apparatus according to an exemplary embodiment includes a display panel 100, a panel driver 130, a timing controller 200 and a light source apparatus 300.

The display panel 100 includes a plurality of pixels for displaying an image. For example, the number of the pixels is M×N, M and N being natural numbers. Each of the pixels P includes a switching element TR connected to a gate line GL and a data line DL, a liquid crystal capacitor CLC connected to the switching element TR and a storage capacitor CST connected to the switching element TR.

The timing controller 200 receives a control signal CON and an image signal DATA from an external device (not shown). The control signal CON may include a vertical synchronizing signal, a horizontal synchronizing signal and a clock signal. The timing controller 200 generates a first control signal 210 and a second control signal 230 for controlling the panel driver 130 in response to the control signal CON.

The timing controller 200 generates a light source control signal 250 for controlling the light source apparatus 300 in response to the control signal CON.

The panel driver 130 drives the display panel 100 in response to the first and second control signals 210, 230 provided by the timing controller 200.

The panel driver 130 includes a data driver 132 and a gate driver 134. The first control signal 210 controls the driving timing of the data driver. The first control signal 210 may include a clock signal and a horizontal start signal. The second control signal 230 controls the driving timing of the gate driver 134. The second control signal may include a vertical start signal.

The data driver 132 generates a plurality of signals in response to the first control signal 210 and the image signal DATA and provides the generated data signals to the data line DL.

The gate driver 134 generates a gate signal which activates the gate line GL in response to the second control signal 230 and provides the generated gate signal to the gate line GL.

The light source apparatus 300 provides the display panel 100 with light in response to the light source control signal 250 received from the timing controller 200.

The light source apparatus 300 includes a light source module 310, a light sensor 330, a light source controller 350, a data converter 370 and a light source driver 390.

The light source module 310 includes a plurality of colored light sources, and a driving substrate on which the colored light sources are disposed. The colored light sources include a red LED that emits red light, a green LED that emits green light and a blue LED that emits blue light. The light source module 310 may include M×N light-emitting blocks B. Each of the light-emitting blocks B may include a plurality of LEDs.

The light sensor 330 senses the amount of red, green and blue light generated from the red, green and blue LEDs, respectively, and provides the light source controller 350 with sensing data corresponding to the amounts of light sensed.

The light source controller 350 generates a control signal which controls the amount of light emitted from the RGB LEDs based upon the sensing data.

The light source controller 350 may store light information data in a look-up table (LUT), for controlling the amounts of light from the RGB LEDs. The light information data may be a target white color coordinate value and a target luminance value. The light information data may be values obtained through testing in a manufacturing process.

In an exemplary embodiment, the light information data is stored in the light source controller 350. However, the light information data may be stored in a device (not shown) external to the light source controller 350.

The light source controller 350 compares sensing data provided from the light sensor 330 with the light information data to control the amount of colored light emitted from the LEDs. A control signal generated in the light source controller 350 controls the driving signals which are provided to the LEDs, such that the amount of the colored light may be controlled.

For example, the light source controller 350 controls the pulse widths of current provided to the LEDs such that white light maintains the target white color coordinate and the target luminance. Moreover, the light source controller 350 controls the level of the current provided to the LEDs. The sensing data and the pulse width of the current provided to the LED are in a linear relationship.

When sensing data provided to the light source controller 350 exceeds a maximum value of reference data of a control range of the light source controller 350, the data converter 370 converts the sensing data into the control range. The data converter 370 then provides the light source controller 350 with the converted sensing data.

The light source controller 350 generates a control signal for controlling the amount of light from the LEDs based upon the sensing data or upon converted sensing data. The real sensing data is provided from the light sensor 330. The converted sensing data converted in the control range is provided from the data converter 370.

The light source driver 390 provides the RGB LEDs with a driving signal based upon the control signal provided from the light source controller 350.

Figure 2:
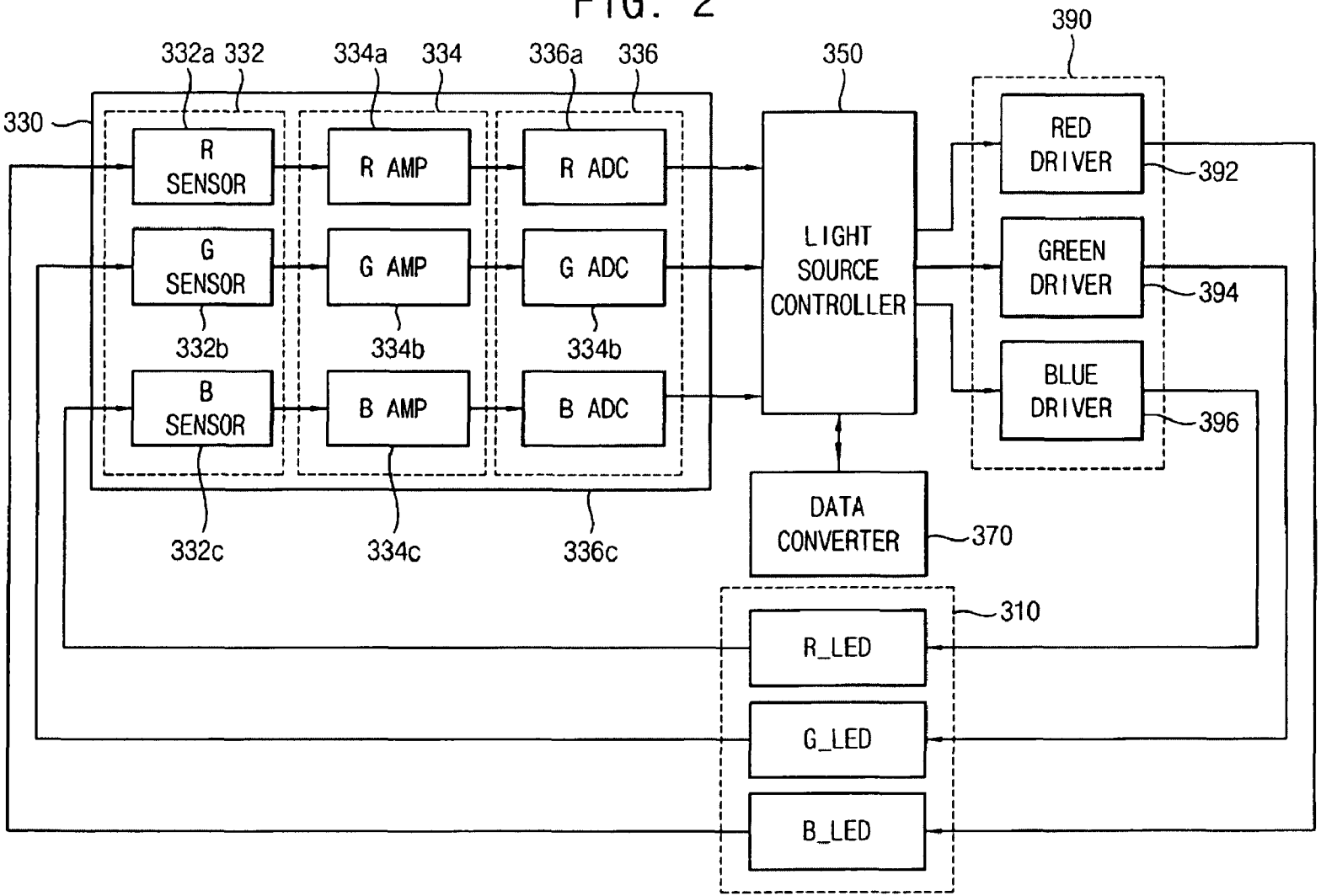
FIG. 2 is a block diagram illustrating a light source apparatus of FIG. 1.

FIG. 2 is a block diagram illustrating the light source apparatus 300 of FIG. 1 in accordance with an exemplary embodiment of the present invention.

Referring to FIGS. 1 and 2, the light source apparatus 300 includes a light source module 310, a light sensor 330, a light source controller 350, a data converter 370 and a light source driver 390.

The light source module 310 includes a red LED R_LED that emits red light, a green LED G_LED that emits green light and a blue LED B_LED that emits blue light.

The light sensor 330 includes a light sensor 332, an amplifier 334 and an analog-digital converter 336.

The light sensor 332 includes a red (R) light sensor **332*a* that senses the amount of the red light emitted from the red LED R_LED, a green (G) light sensor 332*b* that senses the amount of the green light emitted from the green LED G_LED, a blue light sensor 332*c* that senses the amount of the blue light emitted from the blue LED B_LED. The light sensor 332 may be disposed at a center or a side of the light source module 310**.

The red light sensor **332*a*, the green light sensor 332*b* and the blue light sensor 332*c*** may each include multiple sensors sensing light of different wavelength ranges.

The amplifier 334 includes a red (R) light amplifier **334*a*, a green (G) light amplifier 334*b*, and a blue (B) light amplifier 334*c*. The red light amplifier 334*a* amplifies a red light sensing signal outputted from the red light sensor 332*a*. The green light amplifier 334*b* amplifies a green light sensing signal outputted from the green light sensor 332*b*. The blue light amplifier 334*c* amplifies a blue light sensing signal outputted from the blue light sensor 332*c*. Each of the red, green and blue light amplifiers 334*a*, 334*b*, and 334*c*** may include an operational amplifier (OP-AMP) of a low pass filter (LPF).

The analog-digital converter 336 includes a red light analog-digital converter **336*a*, a green light analog-digital converter 336*b* and a blue light analog-digital converter 336*c*. The red analog-digital converter 336*a* converts a red light sensing signal outputted from the red light amplifier 334*a* into digital red light sensing data. The green analog-digital converter 336*b* converts a green light sensing signal outputted from the green light amplifier 334*b* into digital green light sensing data. The blue analog-digital converter 336*c* converts a blue light sensing signal outputted from the blue light amplifier 334*c*** into digital blue light sensing data.

The light source controller 350 compares the sensing data with light information data stored internally or externally and generates a control signal for controlling the amount of the colored light such that the amount of light from the LEDs corresponds with a target white color coordinate value and a target luminance value.

For example, the control signal controls the pulse width of current provided to the LEDs, such that white light maintains the target white color coordinate and the target luminance. Moreover, the control signal controls the level of current provided to the LEDs.

A control range is established in the light source controller 350. The relationship between pulse width of current provided to the LEDs and sensing data measured from the LEDs is linear within the control range. Thus, the amount of colored light is controlled based upon the sensing data measured at the light sensor 330 using the linear relationship.

When the sensing data measured by the light sensor 330 is within the control range, the light source controller 350 compares the light information data and the sensing data to control the amount of light emitted. However, when the LEDs deteriorate, the sensing data may exceed the control range of the light source controller 350. When the sensing data exceeds the control range, the amount of the colored light can not be accurately controlled. Thus, the sensing data needs to be converted into data within the control range by the data converter 370, and the converted sensing data may then be used to control the light amount.

When the sensing data provided to the light source controller 350 exceeds the maximum value of reference data of the control range of the light source controller 350, the data converter 370 converts the sensing data into converted sensing data within the control range. The data converter 370 then provides the light source controller 350 with the converted sensing data. The process by which the data converter 370 converts the sensing data into the control range will now be described with reference to FIG. 3.

The light source controller 350 generates a control signal based upon the sensing data provided from the light sensor 330 or based upon the converted sensing data within the control range provided from the data converter 370, for controlling the amount of light from the LEDs.

The light source driver 390 provides each of the LEDs with a driving signal based upon a control signal provided from the light source controller 350.

The light source driver 390 includes a red driver 392, a green driver 394 and a blue driver 396. The red driver 392 provides the red LED R_LED with a red driving signal to drive the red LED R_LED. The green driver 394 provides the green LED G_LED with a green driving signal to drive the green LED G_LED. The blue driver 396 provides the blue LED B_LED with a blue driving signal to drive the blue LED B_LED.

Figure 3:
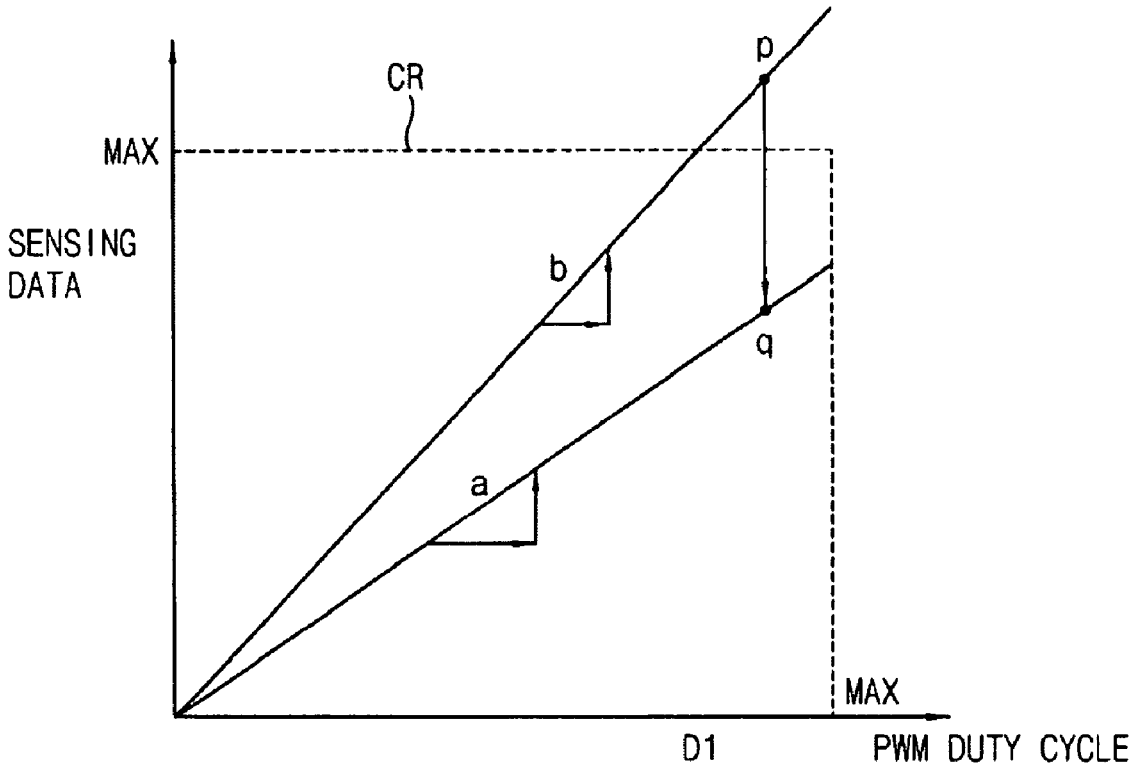
FIG. 3 is a graph illustrating the slope of reference data as a function of the duty cycle of the driving signal and the slope of sensing data as a function of the duty cycle of the driving signal.

FIG. 3 is a graph illustrating the slope of reference data as a function of PWM duty cycle of the driving signal and the slope of sensing data as a function of PWM duty cycle of the driving signal.

Referring to FIG. 3, the relationship between reference data and the duty cycle of a driving signal is linear, and has a slope 'a'. The reference data is an ideal amount of the colored light as a function of the duty cycle of the driving signal at a condition when there is not a deterioration of the LED. The reference data may be set through testing during the manufacturing process.

A control range of the light source controller 350 is the area within box CR shown in FIG. 3. Generally, when the control range is determined considering a temperature margin, the slope 'a' is set to have reference data at about 80% to about 90% of the maximum value of the reference data at the maximum duty cycle of a driving signal.

However, the sensing data can be out of a control range as a result of the deterioration of an LED. The relationship between the sensing data of the LED and the duty cycle of a driving signal is also linear, and has a slope 'b'. The slope 'b' is greater than a slope 'a' between the reference data and the duty cycle of a driving signal. Thus, when real sensing data measured due to the deterioration of the LED exceeds the control range, the sensing data is converted to be within the control range (i.e., moving the data point p to data point q).

Referring to FIGS. 1 to 3, the sensing data converting process of the data converter 370 will now be described.

When the sensing data provided to the light source controller 350 exceeds the maximum value of a reference data of a control range of the light source controller 350, the light source controller 350 provides the data converter 370 with the sensing data.

The data converter 370 converts the sensing data exceeding the maximum value of the reference data into the control range through a calculation according to Equation [1]:

$$GSD=SD*(a/b) \qquad \text{Equation [1]}$$

where GSD is sensing data that is converted to be within the control range, SD is sensing data exceeding the maximum value of the reference data, 'a' is the slope of the reference data as a function of the duty cycle of the driving signal and 'b' is the slope of the sensing data as a function of the duty cycle of the driving signal. A value q, in which sensing data p exceeding the maximum value of the reference data is converted by using Equation 1, is used to control the amount of light. Since not only the relationship between the reference data and the duty cycle of a driving signal is linear but also the relationship between the sensing data of an LED and the duty cycle of the driving signal is linear, the amount of light controlled by the above conversion is achievable.

For example, when the sensing data exceeding the maximum value of the reference data is input to the data converter 370 and the sensing data is equal to the maximum value of the reference data, the data converter 370 outputs a duty cycle value D1 of the driving signal corresponding to the sensing data. The data converter 370 outputs the slope 'b' between real sensing data and a duty cycle of a driving signal based upon the sensing data MAX and a duty cycle value D1 of the driving signal corresponding to the sensing data MAX.

Since the slope 'a' between the reference data and the duty cycle of the driving signal is set, the sensing data p is converted by using Equation 1. Since the relationship between the sensing data and the reference data in accordance with a duty cycle of the driving signal is linear, the sensing data p and the converted sensing data q have a duty cycle of the same driving signal. Thus, the converted sensing data q is used for the amount of light control instead of the sensing data p that exceeds the control range, such that an accurate controlling becomes possible.

Figure 4:
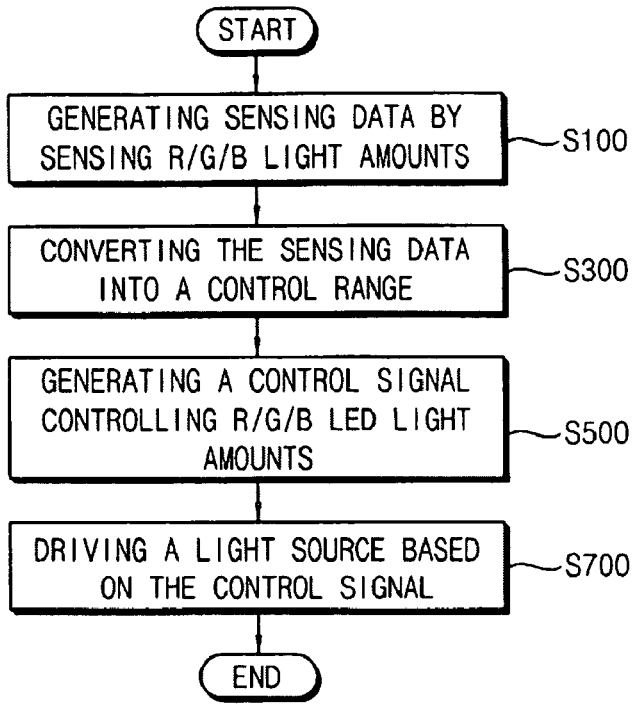
FIG. 4 is a flow chart illustrating a method of driving a light source in accordance with an exemplary embodiment of the present invention.

FIG. 4 is a flow chart illustrating a method of driving a light source in accordance with an exemplary embodiment of the present invention.

Referring to FIG. 4, the amount of colored light generated from a plurality of LEDs is sensed to output sensing data (S100). The LEDs may include a red LED R_LED, a green LED G_LED and a blue LED B_LED. In step S100, the amounts of red, green and blue light are sensed, the sensed amounts of light are amplified, and each of the amplified amounts of light is converted into digital sensing data. For example, the amplified amount of light corresponding to the red light is converted into red light sensing data. The amplified amount of light corresponding to the green light is converted into a green light sensing data. The amplified amount of light corresponding to the blue light is converted into blue light sensing data.

Those skilled in the art would appreciate that the sensing of the amounts of the colored light may be at the different wavelength ranges.

The sensing data which exceeds the maximum value of set reference data of a control range is then converted to be within the control range (S300).

Figure 5:
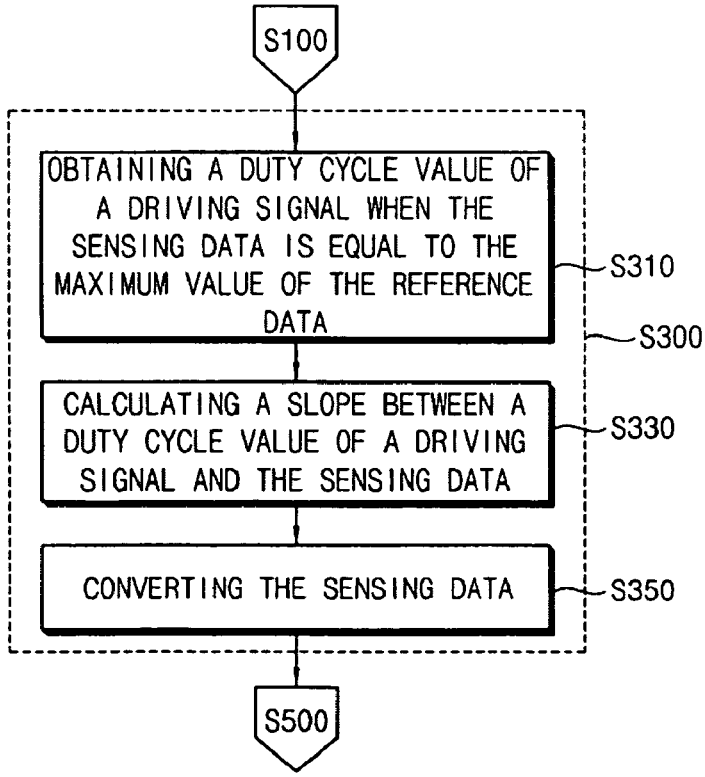
FIG. 5 is a flow chart illustrating step S300 of FIG. 4.

FIG. 5 is a flow chart illustrating step S300 of FIG. 4.

Referring to FIG. 5, when the sensing data is equal to or exceeds the maximum value of the reference data, a duty cycle value of the driving signal corresponding to the sensing data is obtained (S310). Then, the slope between the sensing data and the duty cycle of the driving signal is calculated based upon the sensing data and the duty cycle value of the sensing data (S330). Then, the sensing data is converted to be within the control range (S350).

Step S350 may be realized through a calculation such as Equation [1]. Here, the relationship between the duty cycle of the driving signal provided to the LEDs and the sensing data is linear, and the relationship between the duty cycle of the driving signal and the reference data is also linear. The reference data as a function of the duty cycle of the driving signal is set to have reference data be about 80% to about 90% of the reference data at the maximum duty cycle.

Referring back to FIG. 4, after step S300 is performed in which the sensing data is converted to be within the control range, a control signal which controls the amount of light from the LEDs is generated based upon the sensing data corresponding to no more than the maximum reference value or the converted sensing data (S500). In step S500, a control signal for controlling the amount of the colored light is generated, such that the amount of the colored light from the LEDs corresponds to a target color coordinate value and a target luminance value. For example, the amount of controlling of the LEDs may be performed through PWM of the driving signal.

A driving signal is provided to the LEDs based upon a control signal provided in step S500 so as to drive the LEDs (step S700). The amount of controlling is accomplished by controlling the level of the driving signal.

As described above, when the sensing data exceeds a control range, the sensing data is converted into the control range to control a driving signal provided to LEDs, such that the amount of light may be accurately controlled.

As described above, according to exemplary embodiments of the present invention, when the sensing data provided to a light source controller exceeds the maximum value of reference data of a control range of a light source controller, the sensing data is converted to be within the control range, such that the amount of light emitted by the LEDs can be controlled even though the LEDs may have deteriorated.

The foregoing is illustrative of exemplary embodiments of the present invention and is not to be construed as limiting thereof. Although only a few exemplary embodiments of the present invention have been described, those skilled in the art will readily appreciate that many modifications are possible to the exemplary embodiments without materially departing from their teachings. Therefore, it is to be understood that the foregoing is not to be construed as being limited to the specific exemplary embodiments disclosed, and that modifications to the disclosed exemplary embodiments, as well as other exemplary embodiments, are intended to be included within the scope of the appended claims.

What is claimed is:

1. A method of driving a light source, the method comprising:

generating sensing data by sensing an amount of light generated from the light source;

converting the sensing data that exceeds a maximum value of reference data of a control range into converted sensing data within the control range;

generating a control signal that controls the amount of light generated from the light source based upon the sensing data corresponding to no more than the maximum value or based upon the converted sensing data; and driving the light source by a driving signal based upon the control signal, wherein a relationship between the sensing data and a duty cycle of the driving signal is linear, and a relationship between the reference data and the duty cycle of the driving signal is linear, and wherein generating the control signal comprises:

when the sensing data is substantially equal to or exceeds the maximum value of the reference data, obtaining a duty cycle value of the driving signal corresponding to the sensing data;

calculating a slope of the sensing data as a function of the duty cycle of the driving signal; and converting the sensing data into the converted sensing data within the control range based upon the slope.

2. The method of claim 1, wherein converting the sensing data into the converted sensing data within the control range based upon the slope comprises calculating GSD=SD*(a/b), where GSD is the converted sensing data within the control range, SD is the sensing data exceeding the maximum value of the reference data, a is a slope of reference data as the function of the duty cycle of the driving signal, and b is the slope of the sensing data as the function of the duty cycle of the driving signal.

3. The method of claim 2, wherein the reference data that determines the slope of the reference data as the function of the duty cycle of the driving signal is about 80% to about 90% of the maximum value of the reference data at a maximum duty cycle.

4. The method of claim 1, wherein the light source comprises a plurality of light sources generating a colored light.

5. The method of claim 4, wherein generating the sensing data comprises:

sensing the amount of light from each of the light sources to provide sensed amounts of light;

amplifying the sensed amounts of light to provide amplified sensed amounts of light; and generating the sensing data by converting the amplified sensed amounts of light into digital values.

6. The method of claim 5, wherein sensing the amount of light comprises sensing the amount of light at different wavelength ranges.

7. A light source apparatus comprising:

a light source module comprising a light source;

a light sensor that generates sensing data by sensing an amount of light generated from the light source;

a data converter that converts sensing data which exceeds a maximum value of reference data of a control range into converted sensing data within the control range;

a light source controller that generates a control signal that controls the amount of light generated from the light source based upon sensing data corresponding to no more than the maximum value or based upon the converted sensing data; and a light source driver that drives the light source by providing the light source with a driving signal based upon the control signal, wherein a relationship between the sensing data and a duty cycle of the driving signal is linear, and a relationship between the reference data and the duty cycle of the driving signal is linear, wherein the data converter converts the sensing data outside the control range based upon a slope of the sensing data as a function of the duty cycle of the driving signal.

8. The light source apparatus of claim 7, wherein the data converter converts the sensing data by calculating GSD=SD*(a/b), where:

GSD is the converted sensing data within the control range,

SD is the sensing data that exceeds the maximum value of the reference data, a is a slope between the reference data and the duty cycle of the driving signal, and b is a slope between the sensing data and the duty cycle of the driving signal.

9. The light source apparatus of claim 7, wherein the light source comprises a red light-emitting diode, a green light-emitting diode and a blue light-emitting diode.

10. The light source apparatus of claim 8, wherein the light sensor comprises:

a red light sensor that senses an amount of red light emitted from the red light-emitting diode to provide sensed red light data;

a green light sensor that senses an amount of green light emitted from the green light-emitting diode to provide sensed green light data;

a blue light sensor that senses an amount of blue light that is emitted from the blue light-emitting diode to provide sensed blue light data;

a red light amplifier that amplifies the sensed red light data to provide amplified sensed red light data;

a green light amplifier that amplifies the sensed green light data to provide amplified sensed green light data;

a blue light amplifier that amplifies the sensed blue light data to provide amplified sensed blue light data; and an analog-digital converter that converts the amplified sensed red light data into digital red light sensing data, that converts the amplified sensed green light data into digital green light sensing data, and that converts the amplified sensed blue light data into digital blue fight sensing data.

11. The light source apparatus of claim 10, wherein each of the red light sensor, the green light sensor and the blue light sensor comprises a plurality of sensors respectively sensing the amount of red light, green light and blue light at different wavelength ranges.

12. The light source apparatus of claim 7, wherein the control signal controls the amount of light generated from the light source such that the amount of light corresponds to a target color coordinate value and a target luminance value.

13. A light source apparatus comprising:

a light source module comprising a light source;

a light sensor that generates sensing data by sensing an amount of light generated from the light source;

a data converter that converts sensing data which exceeds a maximum value of reference data of a control range into converted sensing data within the control range;

a light source controller that generates a control signal that controls the amount of light generated from the light source based upon sensing data corresponding to no more than the maximum value or based upon the converted sensing data; and a light source driver that drives the light source by providing the light source with a driving signal based upon the control signal, wherein the control signal controls the amount of light generated from the light source by a pulse width modulation of the driving signal, and wherein both pulse widths and pulse levels of current provided to the light source are controlled such that white light maintains a target white color coordinate and a target luminance, wherein a reference data that determines a slope of the reference data as a function of a duty cycle of the driving signal is about 80% to about 90% of the maximum value of the reference data at a maximum duty cycle.

14. A display apparatus comprising:

a display panel that displays an image;

a light source module comprising a light source, the light source module providing the display panel with light;

a light sensor that generates sensing data by sensing an amount of light generated from the light source;

a data converter that converts sensing data which exceeds a maximum value of reference data of a control range into converted sensing data within the control range;

a light source controller that generates a control signal for controlling the amount of light generated from the light source based upon sensing data corresponding to no more than the maximum value or based upon the converted sensing data; and a light source driver that drives the light source by providing the light source with a driving signal based upon the control signal, wherein the control signal controls the amount of light generated from the light source by a pulse width modulation of the driving signal, wherein both pulse widths and pulse levels of current provided to the light source are controlled such that white light maintains a target white color coordinate and a target luminance, wherein a relationship between the sensing data and a duty cycle of the driving signal is linear, and a relationship between the reference data and the duty cycle of the driving signal is linear, and wherein the data converter converts the sensing data outside the control range based upon a slope sensing data as a function of duty cycle of the signal.

* * * * *